US012024788B1

(12) United States Patent
Liu et al.

(10) Patent No.: US 12,024,788 B1
(45) Date of Patent: Jul. 2, 2024

(54) BONDING COPPER WIRE PLATED WITH PALLADIUM AND GOLD AND ELECTROPLATING PROCESS THEREOF

(71) Applicant: SHANGHAI WONSUNG ALLOY MATERIAL CO., LTD., Shanghai (CN)

(72) Inventors: Shi Liu, Shanghai (CN); Yi Liu, Shanghai (CN); Baichuan Liu, Shanghai (CN)

(73) Assignee: SHANGHAI WONSUNG ALLOY MATERIAL CO., LTD., Shanghai (CN)

( * ) Notice: Subject to any disclaimer, the term of this patent is extended or adjusted under 35 U.S.C. 154(b) by 0 days.

(21) Appl. No.: 18/513,951

(22) Filed: Nov. 20, 2023

Related U.S. Application Data

(63) Continuation of application No. PCT/CN2023/103921, filed on Jun. 29, 2023.

(30) Foreign Application Priority Data

Jun. 25, 2023 (CN) ..... 202310754554.X

(51) Int. Cl.

| | |
|---|---|
| ***C25D 3/52*** | (2006.01) |
| ***C25D 3/48*** | (2006.01) |
| ***C25D 5/10*** | (2006.01) |
| ***C25D 5/48*** | (2006.01) |
| ***C25D 7/06*** | (2006.01) |

(52) U.S. Cl.
CPC ..... *C25D 5/10* (2013.01); *C25D 3/48* (2013.01); *C25D 3/52* (2013.01); *C25D 5/48* (2013.01); *C25D 7/0607* (2013.01)

(58) Field of Classification Search
None
See application file for complete search history.

(56) References Cited

U.S. PATENT DOCUMENTS

2020/0095686 A1* 3/2020 Polczynski ..... C23C 18/44
2022/0033973 A1* 2/2022 Maekawa ..... C23C 18/44

OTHER PUBLICATIONS

English translation CN 109136887 (Year: 2019).*
English translation WO2020101566 (Year: 2020).*
English translation JPH09235691 (Year: 1997).*

* cited by examiner

*Primary Examiner* — Stefanie S Wittenberg
(74) *Attorney, Agent, or Firm* — Cooper Legal Group, LLC

(57) ABSTRACT

The present application relates to the technical field of electroplating, and particularly to a bonding copper wire plated with palladium and gold and an electroplating process thereof. The electroplating process includes: electroplating a first palladium layer on a surface of a copper wire with a first palladium plating solution, electroplating a second gold layer with a first gold plating solution to obtain a semi-finished product, electroplating a third palladium layer onto the semi-finished product with a second palladium plating solution, and electroplating a fourth gold layer with a second gold plating solution to obtain a finished product; and the first palladium plating solution comprises tetraamminepalladium acetate, 4-sulfamoylbenzoic acid and 6-azauracil.

8 Claims, 2 Drawing Sheets

BONDING COPPER WIRE PLATED WITH PALLADIUM AND GOLD AND ELECTROPLATING PROCESS THEREOF

CROSS-REFERENCE TO RELATED APPLICATION

This application is a continuation of PCT application serial no. PCT/CN2023/103921, filed on Jun. 29, 2023, which claims the priority and benefit of Chinese patent application serial no. 202310754554.X, filed on Jun. 25, 2023. The entireties of PCT application serial no. PCT/CN2023/103921 and Chinese patent application serial no. 202310754554.X are hereby incorporated by reference herein and made a part of this specification.

TECHNICAL FIELD

The present application relates to the technical field of electroplating, and particularly to a bonding copper wire plated with palladium and gold and an electroplating process thereof.

BACKGROUND ART

In general, the bonding wire is prepared by using a cheap metal as the core wire, and being plated with a precious metal layer that has acid resistance, alkali resistance and oxidation-resistance. The bonding wire may be used for packaging semiconductors such as LED and IC, and connecting a pin and a silicon wafer, so as to transmit electrical signal. The bonding wire is cheap and can replace the traditional gold wire, so as to reduce the cost. An ordinary bonding wire should have excellent properties such as electrical property, heat-conducting property, mechanical property, and chemical stability. However, some related bonding wire has problems of low coverage rate of a plated layer, poor chemical resistance after being welded, and the like.

SUMMARY

In order to solve problems of low coverage rate of a plated layer and poor chemical resistance after being welded for some related bonding wire. The present application provides a bonding copper wire plated with palladium and gold and an electroplating process thereof, adopting the following technical solution.

In a first aspect, the present application discloses an electroplating process for a bonding copper wire plated with palladium and gold, adopting the following technical solution.

The electroplating process for a bonding copper wire plated with palladium and gold includes:

electroplating a first palladium layer on a surface of a copper wire with a first palladium plating solution, electroplating a second gold layer with a first gold plating solution to obtain a semi-finished product, electroplating a third palladium layer onto the semi-finished product with a second palladium plating solution, and electroplating a fourth gold layer with a second gold plating solution to obtain a finished product; and the first palladium plating solution includes tetraamminepalladium acetate, 4-sulfamoylbenzoic acid and 6-azauracil.

By adopting the above technical solution, palladium of the tetraamminepalladium acetate in the first palladium plating solution is connected with two acetic acid groups, which can be complexed with a sulfonamide group and a carboxyl group at two ends of 4-sulfamoylbenzoic acid. 6-azauracil has a planar pyrimidine heterocycle, a carbonyl group in the planar pyrimidine heterocycle can be complexed with a sulfonamide group and a carboxyl group of 4-sulfamoylbenzoic acid since they can form electrical clouds after attracting with each other, by which a deposition rate of palladium can be buffered, so that the palladium has a uniform deposition speed on the surface of the copper wire, and the palladium particles deposited are refined. A complexed structure of the 4-sulfamoylbenzoic acid and 6-azauracil can prevent other impurities from approaching the surface of the copper wire, such that a dense first palladium layer with an even thickness is obtained, and the plated first palladium layer has a large coverage rate, and bubbles, bulge, miss plating and the like are not easily produced. Therefore, the first palladium layer has a high purity and is not easy to be peeled off from the copper wire. After the dense first palladium layer is electroplated on the surface of the copper wire, the subsequent second gold layer, the third palladium layer and the fourth gold layer can be bonded tighter, so that each plated layer is not easy to be peeled off and has a large coverage rate, the protection to the copper wire can be strengthened, and the copper wire is not easy to be oxidized and corroded by acid and alkali and can conduct electric charge efficiently. Since the copper, palladium and gold have a certain figurability, two ends are melted as a spherical shape or a flat disc shape when being welded, each plated layer still covers the copper wire and is not easy to be cracked and be peeled, so that the copper wire is effectively protected and not easy to be oxidized or corroded by acid and alkali, thereby improving the reliability and service life of the bonding wire.

In some embodiments, in an electroplating process, in the first palladium plating solution, a concentration of the tetraamminepalladium acetate is maintained at 5-8 g/L, a concentration of the 4-sulfamoylbenzoic acid is maintained at 5-15 mg/L and a concentration of the 6-azauracil is maintained at 1-5 mg/L.

By adopting the above technical solution, the dense first palladium layer can be obtained. When the tetraamminepalladium acetate has a too large concentration, deposition uniformity can be affected. And when the tetraamminepalladium acetate has a too small concentration, the electroplating efficiency is too low, and the plated layer is likely to be uneven. When the 4-sulfamoylbenzoic acid and the 6-azauracil have too large concentration, a the complexation is improved, the deposition efficiency is decreased, and the plated layer is likely to be uneven as well. And when the 4-sulfamoylbenzoic acid and the 6-azauracil have too small concentration, the complexation is decreased and the deposition uniformity is affected as well.

In some embodiments, the first palladium plating solution further includes methionine; and methionine has a concentration of 10-20 mg/L in the first palladium plating solution.

By adopting the above technical solution, the methionine has a chain end carboxyl group, an end amino group and carbon-sulfur bonds, which can combine with the 4-sulfamoylbenzoic acid and 6-azauracil to increase the desorption efficiency after palladium deposition, so that the 4-sulfamoylbenzoic acid and 6-azauracil can quickly function again, improving the reaction efficiency.

In some embodiments, the second palladium plating solution includes a palladium salt, 3-chloro-4-fluoroaniline, calcium dinonylnaphthalene sulfonate and β-cyano-L-alanine.

By adopting the above technical solution, the 3-chloro-4-fluoroaniline has strong attraction to palladium atom, so as to be complexed with palladium salt. The calcium dinonylnaphthalene sulfonate has an effect of dispersing the 3-chloro-4-fluoroaniline. The β-cyano-L-alanine has an effect of stabling above dispersion effect, which can improve the deposition uniformity and densification of palladium, so as to obtain the third palladium layer with a large coverage rate. The third palladium layer is able to tightly cover on the second gold layer, and provide an base with a strong adhesion for the fourth gold layer.

In some embodiments, the palladium salt is one or more selected from the group consisting of tetraamminepalladium (II) dichloride, diaminedinitritopalladium(II), palladium diammine dichloride and trans-dibromodiamminpalladium (II).

By adopting the above technical solution, the above palladium salts all can be complexed by the 3-chloro-4-fluoroaniline, dispersed by the calcium dinonylnaphthalene sulfonate, and stabilized by the β-cyano-L-alanine, such that the deposition speed on the copper wire is decreased and an even and dense plated layer is obtained.

In some embodiments, in an electroplating process, in the second palladium plating solution, a concentration of the palladium salt is maintained at 6-10 g/L, a concentration of the 3-chloro-4-fluoroaniline is maintained at 3-13 mg/L, a concentration of the calcium dinonylnaphthalene sulfonate is maintained at 2-6 mg/L, and a concentration of the β-cyano-L-alanine is maintained at 12-22 mg/L.

By adopting the above technical solution, a dense third palladium layer can be obtained, which can be tightly bonded with the second gold layer and the fourth gold layer. When the palladium salt has a too large concentration, the deposition uniformity is affected. And when the palladium salt has a too small concentration, the plating efficiency is too low and an uneven plated layer is likely to be obtained. When the 3-chloro-4-fluoroaniline has a too large concentration, the complexation is improved, the deposition efficiency is decreased and the uneven plated layer is likely to be obtained as well. And when the 3-chloro-4-fluoroaniline has a too small concentration, the complexation is decreased and the deposition uniformity is affected as well. The calcium dinonylnaphthalene sulfonate that has a too large or too small concentration will decrease the dispersion action. The-cyano-L-alanine that has a too large or too small concentration will decrease the stabilizing function.

In some embodiments, both the first gold plating solution and the second gold plating solution are potassium dicyanoaurate solution; and both the first gold plating solution and the second gold plating solution have a pH of 10-15 during a process of adjusting the first gold plating solution and the second gold plating solution by ammonia.

By adopting the above technical solution, in alkaline liquid, a hydroxide, acting as an electron donating group, can balance an electron withdrawing group of Au ion to precipitate, so as to improve an electroplating efficiency of gold.

In some embodiments, the copper wire has a diameter of 180-220 μm; the electroplating process for a bonding copper wire plated with palladium and gold further includes performing a first wire drawing to the semi-finished product, and the semi-finished product has a diameter of 90-105 μm after the first wire drawing; and the electroplating process for a bonding copper wire plated with palladium and gold further includes performing a second wire drawing to the finished product, and the finished product has a diameter of 15-22 μm after the second wire drawing.

By adopting the above technical solution, twice of wire drawing processes are performed for a thick wire, by which a larger electroplating efficiency is obtained than that of a thin wire. Further, the copper and the plated layer both have good ductility, so the plated layer is still fully covered after wire drawing.

In some embodiments, the electroplating the first palladium layer, the electroplating the second gold layer, the electroplating the third palladium layer and the electroplating the fourth gold layer are performed at a temperature of 70-85° C., with an current of 10-80 mA, for a period of 10-30 min.

By adopting the above technical solution, a high electroplating efficiency, an even and dense electroplating layer and strong adhesion can be obtained by adopting the above electroplating parameters of temperature, current and period.

In a second aspect, the present application also discloses a bonding copper wire plated with palladium and gold, adopting the following technical solution.

The bonding copper wire plated with palladium and gold is prepared by the electroplating process for a bonding copper wire plated with palladium and gold described above, and the bonding copper wire plated with palladium and gold includes a copper core wire, the first palladium layer, the second gold layer, the third palladium layer and the fourth gold layer arranged from inside to outside.

By adopting the above technical solution, the bonding copper wire plated with palladium and gold, including the first palladium layer, the second gold layer, the third palladium layer and the fourth gold layer, can be prepared. Each of the plated layer is uniform, has a large coverage rate and a strong adhesion, is not easy to be cracked and be peeled. Even after being welded and deformed at an end, the copper core wire is still totally covered by each plated layer, so it has chemical resistance. The bonding copper wire can be applied to electronic products such as LED, due to its high conductivity and thermal conductivity, and high reliability.

In summary, the bonding copper wire plated with palladium and gold and the electroplating process thereof in present application can achieve one of the following beneficial effects.

During the electroplating process for a bonding copper wire plated with palladium and gold, since each component in the first palladium plating solution has the effects such as complexation, buffering, the palladium has a uniform deposition speed on the surface of the copper wire, the palladium particles deposited are refined, the dense first palladium layer can be obtained, and the plated layer has a large coverage rate and is not easy to be peeled off from the copper wire.

After the dense first palladium layer is electroplated on the surface of the copper wire, the subsequent second gold layer, the third palladium layer and the fourth gold layer can be bonded tighter, so that each plated layer is not easy to be peeled off and has a large coverage rate, the protection to the copper wire can be strengthened, and a wire body and end thereof are not easy to be oxidized and corroded by acid and alkali.

DETAILED DESCRIPTION

Example 1

Figure 1:
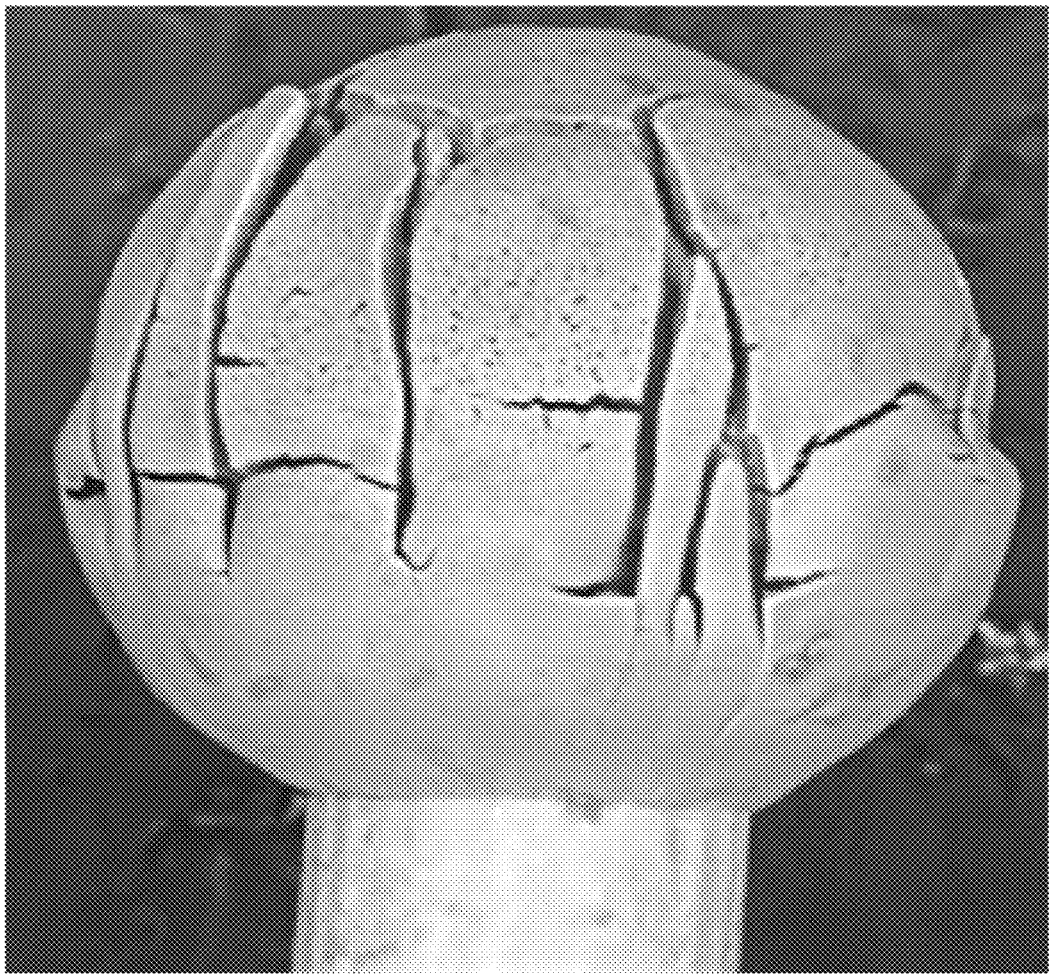
FIG. 1 is a SEM image of a spherical end formed by a bonding copper wire plated with palladium and gold prepared in Example 1 after electrolytic corrosion.

In this example, a bonding copper wire plated with palladium and gold was prepared, and the electroplating process for a bonding copper wire plated with palladium and gold includes:

electroplating a first palladium layer on a surface of a copper wire with a first palladium plating solution, electroplating a second gold layer with a first gold plating solution to obtain a semi-finished product, electroplating a third palladium layer onto the semi-finished product with a second palladium plating solution, and electroplating a fourth gold layer with a second gold plating solution to obtain a finished product, i.e., the bonding copper wire plated with palladium and gold. The bonding copper wire plated with palladium and gold included a copper core wire, the first palladium layer, the second gold layer, the third palladium layer and the fourth gold layer arranged from inside to outside.

The electroplating the first palladium layer, the electroplating the second gold layer, the electroplating the third palladium layer and the electroplating the fourth gold layer were performed at a temperature of 70° C., with an current of 10 mA, for a period of 10 min.

The first palladium plating solution included tetraamminepalladium acetate, 4-sulfamoylbenzoic acid and 6-azauracil. During an electroplating process, in the first palladium plating solution, the concentration of the tetraamminepalladium acetate is maintained at 7-8 g/L, the concentration of the 4-sulfamoylbenzoic acid is maintained at 12-15 mg/L and the concentration of the 6-azauracil is maintained at 1-2 mg/L.

The second palladium plating solution included tetraamminepalladium(II) dichloride, 3-chloro-4-fluoroaniline, calcium dinonylnaphthalene sulfonate and β-cyano-L-alanine. During the electroplating process, in the second palladium plating solution, the concentration of the tetraamminepalladium(II) dichloride was maintained at 6-8 g/L, the concentration of the 3-chloro-4-fluoroaniline was maintained at 10-13 mg/L, the concentration of the calcium dinonylnaphthalene sulfonate was maintained at 2-4 mg/L, and the concentration of the β-cyano-L-alanine was maintained at 18-22 mg/L.

Both the first gold plating solution and the second gold plating solution were potassium dicyanoaurate solution. The potassium dicyanoaurate in the first gold plating solution and the second gold plating solution was maintained at the concentration of 6-8 g/L. During a process of adjusting the first gold plating solution and the second gold plating solution by ammonia, both the first gold plating solution and the second gold plating solution had a pH of 10-12.5.

Example 2

Comparing with Example 1, in this example, the temperature, current and period of electroplating, proportion and pH of each plating solution, and types of palladium salt were adjusted.

In this example, a bonding copper wire plated with palladium and gold was prepared, and the electroplating process for a bonding copper wire plated with palladium and gold includes:

electroplating a first palladium layer on a surface of a copper wire with a first palladium plating solution, electroplating a second gold layer with a first gold plating solution to obtain a semi-finished product, electroplating a third palladium layer onto the semi-finished product with a second palladium plating solution, and electroplating a fourth gold layer with a second gold plating solution to obtain a finished product, i.e., the bonding copper wire plated with palladium and gold. The bonding copper wire plated with palladium and gold included a copper core wire, the first palladium layer, the second gold layer, the third palladium layer and the fourth gold layer arranged from inside to outside.

The electroplating the first palladium layer, the electroplating the second gold layer, the electroplating the third palladium layer and the electroplating the fourth gold layer were performed at a temperature of 85° C., with an current of 80 mA, for a period of 30 min.

The first palladium plating solution included tetraamminepalladium acetate, 4-sulfamoylbenzoic acid and 6-azauracil. During the electroplating process, in the first palladium plating solution, the concentration of the tetraamminepalladium acetate was maintained at 5-6 g/L, the concentration of the 4-sulfamoylbenzoic acid was maintained at 5-8 mg/L and the concentration of the 6-azauracil was maintained at 4-5 mg/L.

The second palladium plating solution included diaminedinitritopalladium(II), 3-chloro-4-fluoroaniline, calcium dinonylnaphthalene sulfonate and β-cyano-L-alanine. During the electroplating process, in the second palladium plating solution, the concentration of the diaminedinitritopalladium(II) was maintained at 8-10 g/L, the concentration of the 3-chloro-4-fluoroaniline was maintained at 3-5 mg/L, the concentration of the calcium dinonylnaphthalene sulfonate was maintained at 4-6 mg/L, and the concentration of the β-cyano-L-alanine was maintained at 12-15 mg/L.

Both the first gold plating solution and the second gold plating solution were potassium dicyanoaurate solution. The potassium dicyanoaurate in the first gold plating solution and the second gold plating solution was maintained at a concentration of 6-8 g/L. During the process of adjusting the first gold plating solution and the second gold plating solution by ammonia, both the first gold plating solution and the second gold plating solution had a pH of 13-15.

Example 3

In this example, the temperature, current and period of electroplating, proportion and pH of each plating solution, and types of palladium salt were adjusted relative to Example 1, and methionine was added into the first palladium plating solution.

In this example, a bonding copper wire plated with palladium and gold was prepared, and the electroplating process for a bonding copper wire plated with palladium and gold includes:

electroplating a first palladium layer on a surface of a copper wire with a first palladium plating solution, electroplating a second gold layer with a first gold plating solution to obtain a semi-finished product, electroplating a third palladium layer onto the semi-finished product with a second palladium plating solution, and electroplating a fourth gold layer with a second gold plating solution to obtain a finished product, i.e., the bonding copper wire plated with palladium and gold. The bonding copper wire plated with palladium and gold included a copper core wire, the first palladium layer, the second gold layer, the third palladium layer and the fourth gold layer arranged from inside to outside.

The electroplating the first palladium layer, the electroplating the second gold layer, the electroplating the third palladium layer and the electroplating the fourth gold layer were performed at a temperature of 75° C., with an current of 40 mA, for a period of 20 min.

The first palladium plating solution included tetraamminepalladium acetate, 4-sulfamoylbenzoic acid, 6-azauracil, and methionine. During the electroplating process, in the first palladium plating solution, the concentration of the tetraamminepalladium acetate was maintained at 6-7 g/L, the concentration of the 4-sulfamoylbenzoic acid was maintained at 9-11 mg/L, the concentration of the 6-azauracil was maintained at 3-4 mg/L, and the concentration of the methionine was maintained at 10-12 mg/L.

The second palladium plating solution included palladium diammine dichloride, 3-chloro-4-fluoroaniline, calcium dinonylnaphthalene sulfonate and β-cyano-L-alanine. During the electroplating process, in the second palladium plating solution, the concentration of palladium diammine dichloride was maintained at 7-8.5 g/L, the concentration of the 3-chloro-4-fluoroaniline was maintained at 8-10 mg/L, the concentration of the calcium dinonylnaphthalene sulfonate was maintained at 3-4 mg/L, and the concentration of the β-cyano-L-alanine was maintained at 16-18 mg/L.

Both the first gold plating solution and the second gold plating solution were potassium dicyanoaurate solution. The potassium dicyanoaurate in the first gold plating solution and the second gold plating solution was maintained at the concentration of 6-7 g/L. During the process of adjusting the first gold plating solution and the second gold plating solution by ammonia, both the first gold plating solution and the second gold plating solution had a pH of 12-13.

Example 4

Comparing with Example 1, in this example, the temperature, current and period of electroplating, proportion and pH of each plating solution, and types of palladium salt were adjusted, and methionine was added into the first palladium plating solution.

In this example, a bonding copper wire plated with palladium and gold was prepared, and the electroplating process for a bonding copper wire plated with palladium and gold includes:

electroplating a first palladium layer on a surface of a copper wire with a first palladium plating solution, electroplating a second gold layer with a first gold plating solution to obtain a semi-finished product, electroplating a third palladium layer onto the semi-finished product with a second palladium plating solution, and electroplating a fourth gold layer with a second gold plating solution to obtain a finished product, i.e., the bonding copper wire plated with palladium and gold. The bonding copper wire plated with palladium and gold included a copper core wire, the first palladium layer, the second gold layer, the third palladium layer and the fourth gold layer arranged from inside to outside.

The electroplating the first palladium layer, the electroplating the second gold layer, the electroplating the third palladium layer and the electroplating the fourth gold layer were performed at a temperature of 73 ºC, with an current of 60 mA, for a period of 25 min.

The first palladium plating solution included tetraamminepalladium acetate, 4-sulfamoylbenzoic acid, 6-azauracil and methionine. During the electroplating process, in the first palladium plating solution, the concentration of the tetraamminepalladium acetate was maintained at 6-7 g/L, the concentration of the 4-sulfamoylbenzoic acid was maintained at 8-10 mg/L, the concentration of the 6-azauracil was maintained at 4-5 mg/L, and the concentration of the methionine was maintained at 18-20 mg/L.

The second palladium plating solution included trans-dibromodiamminpalladium (II), 3-chloro-4-fluoroaniline, calcium dinonylnaphthalene sulfonate and β-cyano-L-alanine. During the electroplating process, in the second palladium plating solution, the concentration of the trans-dibromodiamminpalladium (II) was maintained at 8-9 g/L, the concentration of the 3-chloro-4-fluoroaniline was maintained at 6-8 mg/L, the concentration of the calcium dinonylnaphthalene sulfonate was maintained at 5-6 mg/L, and the concentration of the β-cyano-L-alanine was maintained at 20-22 mg/L.

Both the first gold plating solution and the second gold plating solution were potassium dicyanoaurate solution. The potassium dicyanoaurate in the first gold plating solution and the second gold plating solution was maintained at the concentration of 7-8 g/L. During the process of adjusting the first gold plating solution and the second gold plating solution by ammonia, both the first gold plating solution and the second gold plating solution had a pH of 11-12.

Example 5

Comparing with Example 1, in this example, the temperature, current and period of electroplating, proportion and pH of each plating solution, and types of palladium salt were adjusted, methionine was added into the first palladium plating solution, and twice of wire drawing processes were performed for copper wire plated layer.

In this example, a bonding copper wire plated with palladium and gold was prepared, and the electroplating process for a bonding copper wire plated with palladium and gold includes:

Selecting a copper wire with a diameter of 200 μm, electroplating the first palladium layer on a surface of the copper wire with a first palladium plating solution, and electroplating a second gold layer with a first gold plating solution to obtain a semi-finished product; performing a first wire drawing to the semi-finished product, and the semi-finished product had a diameter of 97 μm after the first wire drawing; then electroplating a third palladium layer on the semi-finished product with a second palladium plating solution, electroplating a fourth gold layer with a second gold plating solution to obtain the finished product, and performing a second wire drawing to the finished product, and the finished product had a diameter of 18 μm after the second wire drawing. The obtained bonding copper wire plated with palladium and gold included the copper core wire, the first palladium layer, the second gold layer, the third palladium layer and the fourth gold layer arranged from inside to outside.

The electroplating the first palladium layer, the electroplating the second gold layer, the electroplating the third palladium layer and the electroplating the fourth gold layer were performed at a temperature of 77 ºC, with an current of 35 mA, for a period of 30 min.

The first palladium plating solution included tetraamminepalladium acetate, 4-sulfamoylbenzoic acid, 6-azauracil and methionine. During the electroplating process, in the first palladium plating solution, the concentration of the tetraamminepalladium acetate was maintained at 6-7 g/L, the concentration of the 4-sulfamoylbenzoic acid was maintained at 11-13 mg/L, the concentration of the 6-azauracil was maintained at 4-5 mg/L, and the concentration of the methionine was maintained at 14-16 mg/L.

The second palladium plating solution included palladium diammine dichloride, 3-chloro-4-fluoroaniline, calcium dinonylnaphthalene sulfonate and β-cyano-L-alanine. During the electroplating process, in the second palladium plating solution, the concentration of the palladium diammine dichloride was maintained at 6-7 g/L, the concentration of the 3-chloro-4-fluoroaniline was maintained at 10-12 mg/L, the concentration of the calcium dinonylnaphthalene sulfonate was maintained at 3-4.5 mg/L, and the concentration of the β-cyano-L-alanine was maintained at 15-17 mg/L.

Both the first gold plating solution and the second gold plating solution were potassium dicyanoaurate solution. The potassium dicyanoaurate in the first gold plating solution and the second gold plating solution was maintained at the concentration of 7-8 g/L. During the process of adjusting the first gold plating solution and the second gold plating solution by ammonia, both the first gold plating solution and the second gold plating solution had the pH of 12-13.

Comparative Example 1

The technical solution of this comparative example is same as that of Example 1, except that the first palladium plating solution did not include the 4-sulfamoylbenzoic acid.

In particular, the first palladium plating solution included tetraamminepalladium acetate and 6-azauracil. During the electroplating process, in the first palladium plating solution, the concentration of the tetraamminepalladium acetate was maintained at 7-8 g/L, and the concentration of the 6-azauracil was maintained at 1-2 mg/L.

A bonding copper wire plated with palladium and gold was prepared.

Comparative Example 2

The technical solution of this comparative example is same as that of Example 1, except that the first palladium plating solution did not include the 6-azauracil.

In particular, the first palladium plating solution includes tetraamminepalladium acetate and 4-sulfamoylbenzoic acid. During the electroplating process, in the first palladium plating solution, the concentration of the tetraamminepalladium acetate was maintained at 7-8 g/L, and the concentration of the 4-sulfamoylbenzoic acid was maintained at 12-15 mg/L.

A bonding copper wire plated with palladium and gold was prepared.

Comparative Example 3

The technical solution of this comparative example is same as that of Example 1, except that the second palladium plating solution did not include the 3-chloro-4-fluoroaniline.

In particular, the second palladium plating solution includes tetraamminepalladium(II) dichloride, calcium dinonylnaphthalene sulfonate and β-cyano-L-alanine. During the electroplating process, in the second palladium plating solution, the concentration of the tetraamminepalladium(II) dichloride was maintained at 6-8 g/L, the concentration of the calcium dinonylnaphthalene sulfonate was maintained at 2-4 mg/L, and the concentration of the β-cyano-L-alanine was maintained at 18-22 mg/L.

A bonding copper wire plated with palladium and gold was prepared.

Comparative Example 4

The technical solution of this comparative example is same as that of Example 1, except that the second palladium plating solution did not include the calcium dinonylnaphthalene sulfonate.

In particular, the second palladium plating solution includes tetraamminepalladium(II) dichloride, 3-chloro-4-fluoroaniline and β-cyano-L-alanine. During the electroplating process, in the second palladium plating solution, the concentration of the tetraamminepalladium(II) dichloride was maintained at 6-8 g/L, the concentration of the 3-chloro-4-fluoroaniline was maintained at 10-13 mg/L, and the concentration of the β-cyano-L-alanine was maintained at 18-22 mg/L.

A bonding copper wire plated with palladium and gold was prepared.

Comparative Example 5

The technical solution of this comparative example is same as that of Example 1, except that the second palladium plating solution did not include the β-cyano-L-alanine.

In particular, the second palladium plating solution includes tetraamminepalladium(II) dichloride, 3-chloro-4-fluoroaniline and calcium dinonylnaphthalene sulfonate. During the electroplating process, in the second palladium plating solution, the concentration of the tetraamminepalladium(II) dichloride was maintained at 6-8 g/L, the concentration of the 3-chloro-4-fluoroaniline was maintained at 10-13 mg/L, and the concentration of the calcium dinonylnaphthalene sulfonate was maintained at 2-4 mg/L.

A bonding copper wire plated with palladium and gold was prepared.

Comparative Example 6

The technical solution of this comparative example is same as that of Example 1, except that the components of the first palladium plating solution and the second palladium plating solution are different from Example 1.

The first palladium plating solution included tetraamminepalladium(II) dichloride, ethylenediamine (acting as a ligand) and sodium sulfate (enhancing the conductivity of the solution). During the electroplating process, the concentration of the tetraamminepalladium(II) dichloride was maintained at 7-8 g/L, the concentration of the ethylenediamine was maintained at 1-2 g/L, and the concentration of sodium sulfate was maintained at 5-6 g/L.

The second palladium plating solution adopted in this comparative example has the same components as the first palladium plating solution.

A bonding copper wire plated with palladium and gold was prepared.

Test Example 1

The bonding copper wires plated with palladium and gold prepared in Examples 1-5 and Comparative examples 1-6 were tested with resistivity test and repeated bending tensile test. The results were shown in table 1.

Table 1. Resistivity test and bending tensile test of the bonding copper wires plated with palladium and gold prepared in examples and comparative examples

| | Appearance | Resistivity/ ($10^{-8}\Omega \cdot m$) | Repeating relative bending tensile test for 50 times, with a semicircle having a diameter of 1 cm formed at a bending part |
|---|---|---|---|
| Example 1 | Smooth and bright surface | 1.7 | No peeling and cracking of a plated layer at the bending part |
| Example 2 | Smooth and bright surface | 1.8 | No peeling and cracking of a plated layer at the bending part |
| Example 3 | Smooth and bright surface | 1.7 | No peeling and cracking of a plated layer at the bending part |
| Example 4 | Smooth and bright surface | 1.6 | No peeling and cracking of a plated layer at the bending part |
| Example 5 | Smooth and bright surface | 1.7 | No peeling and cracking of a plated layer at the bending part |
| Comparative example 1 | Slight speckles | 1.9 | Slight cracking of a plated layer at the bending part |
| Comparative example 2 | Slight bumps | 1.8 | Slight cracking of a plated layer at the bending part |
| Comparative example 3 | Slight dents | 2.0 | Slight cracking of a plated layer at the bending part |
| Comparative example 4 | Slight stripes | 2.1 | Slight cracking of a plated layer at the bending part |
| Comparative example 5 | slight powder spots | 1.8 | Slight cracking of a plated layer at the bending part |
| Comparative example 6 | Slight holes on the surface | 2.0 | Slight cracking of a plated layer at the bending part |

It can be seen from the results in table 1, the bonding copper wires plated with palladium and gold prepared in Examples 1-5 have a smooth and bright surface, lower resistivity and good bending resistance, which are better than the results of the Comparative examples 1-6. The reason is that, the uniformity of the plated layer, the fineness of deposited particles, and the like are affected by the components of the first palladium plating solution and the second palladium plating solution.

Test Example 2

Figure 2:
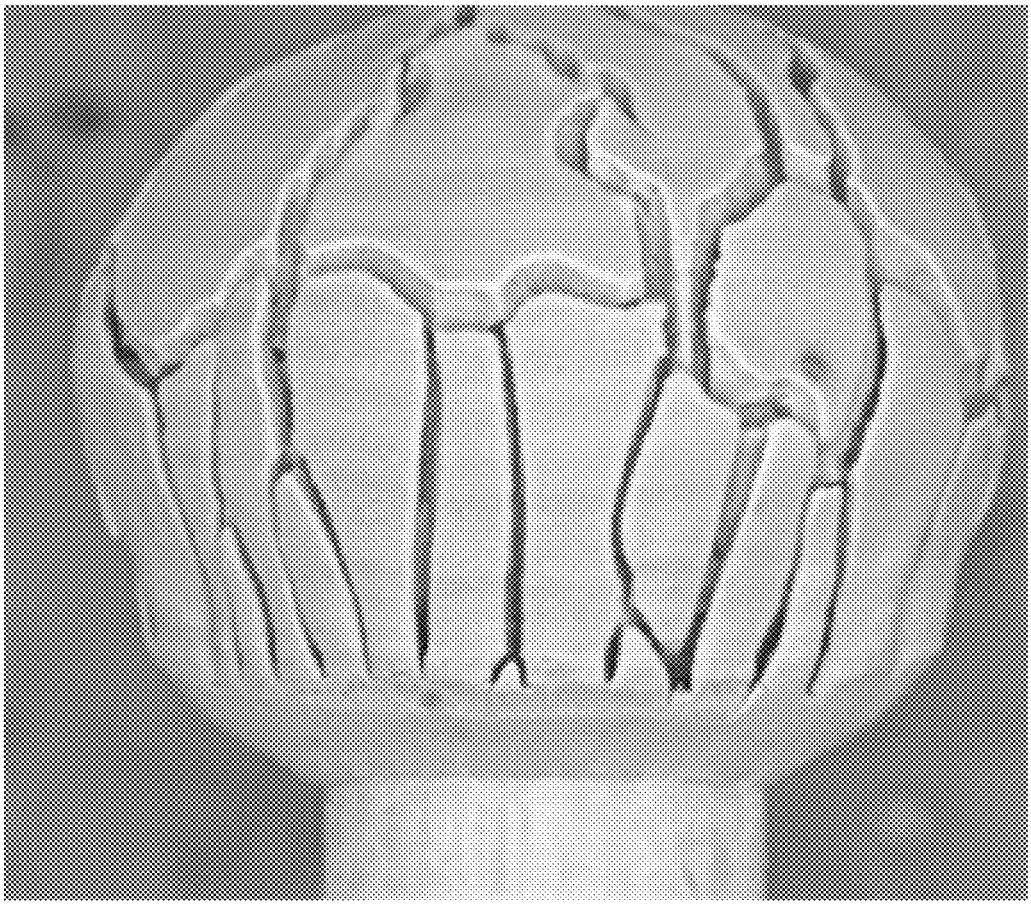
FIG. 2 is a SEM image of a spherical end formed by a bonding copper wire plated with palladium and gold prepared in Comparative example 6 after electrolytic corrosion.

After the bonding wire is welded, the welded end is easy to be corroded to lose efficacy, and the welded end of the bonding wire is generally spherical shape or a flat disc shape. Therefore, the end of the bonding copper wires plated with palladium and gold prepared in Example 1 and Comparative example 6 were prepared as spherical shape, the spherical end is tested with an electrolytic corrosion test (corresponding to an accelerated corrosion test). The electrolytic corrosion test is performed by referring to Standard GB/T 6466-2008, and SEM images of the ends of the bonding wires after electrolytic corrosion test were shown in FIG. 1 and FIG. 2, respectively. FIG. 1 is a SEM image of a spherical end formed by a bonding copper wire plated with palladium and gold prepared in Example 1 after electrolytic corrosion. FIG. 2 is a SEM image of a spherical end formed by a bonding copper wire plated with palladium and gold prepared in Comparative example 6 after electrolytic corrosion.

Comparing FIG. 1 with FIG. 2, the spherical end in FIG. 1 has less cracking after the accelerated corrosion test, and the spherical end in FIG. 2 has more cracking after the accelerated corrosion test. It can be known that, the bonding copper wires plated with palladium and gold prepared in Example 1 has a better corrosion resistance.

Test Example 3

11 identical copper sheets were taken to replace the copper wires of the Examples 1-5 and Comparative examples 1-6, which were used to prepare copper sheets plated with palladium and gold. 11 copper sheets plated with palladium and gold were tested with a surface coverage rate test, and results were shown in table 2.

TABLE 2

| Surface coverage rate test | |
|---|---|
| | Surface coverage rate/% |
| Example 1 | 99.4 |
| Example 2 | 99.3 |
| Example 3 | 99.7 |
| Example 4 | 99.6 |
| Example 5 | 99.2 |
| Comparative example 1 | 93.1 |
| Comparative example 2 | 92.3 |
| Comparative example 3 | 94.4 |
| Comparative example 4 | 96.8 |
| Comparative example 5 | 95.0 |
| Comparative example 6 | 93.2 |

It can be seen from the results in table 2, the coverage rate of the plated layer prepared in Examples 1-5 can reach 99.2-99.7%, which are obviously greater than that of Comparative examples 1-6. In particular, the plated layer in Examples 3-4 have greater coverage rate, the reason is that, compared with Example 1, the first palladium plating solution includes the methionine, which further improves the coverage rate of the plated layer.

In summary, the bonding copper wire plated with palladium and gold prepared by the technical solution of the present application has advantages of even plated layer, large coverage rate, smooth and bright surface, good corrosion resistance, and good bending resistance, and the plated layer is not easy to be peeled off, and has high reliability when it is applied in devices such as semiconductor, and the like.

The above are the preferred embodiments of the present application, which are not intended to limit the protection scope of the present application. Therefore, all equivalent changes made according to the structure, shape and principle of the present application should fall within the protection scope of the present application.

What is claimed is:

1. An electroplating process for a bonding copper wire plated with palladium and gold, comprising:

electroplating a first palladium layer on a surface of a copper wire with a first palladium plating solution, electroplating a first gold layer with a first gold plating solution to obtain a semi-finished product, electroplating a second palladium layer onto the semi-finished product with a second palladium plating solution, and electroplating a second gold layer with a second gold plating solution to obtain a finished product;

wherein the first palladium plating solution comprises tetraamminepalladium acetate, 4-sulfamoylbenzoic acid and 6-azauracil.

2. The electroplating process for a bonding copper wire plated with palladium and gold according to claim 1, wherein in electroplating the first palladium layer, in the first palladium plating solution, a concentration of the tetraamminepalladium acetate is maintained at 5-8 g/L, a concentration of the 4-sulfamoylbenzoic acid is maintained at 5-15 mg/L and a concentration of the 6-azauracil is maintained at 1-5 mg/L.

3. The electroplating process for a bonding copper wire plated with palladium and gold according to claim 1, wherein the first palladium plating solution further comprises methionine; and methionine has a concentration of 10-20 mg/L in the first palladium plating solution.

4. The electroplating process for a bonding copper wire plated with palladium and gold according to claim 1, wherein the second palladium plating solution comprises a palladium salt, 3-chloro-4-fluoroaniline, calcium dinonylnaphthalene sulfonate and β-cyano-L-alanine.

5. The electroplating process for a bonding copper wire plated with palladium and gold according to claim 4, wherein the palladium salt is one or more selected from the group consisting of tetraamminepalladium(II) dichloride, diaminedinitritopalladium(II), palladium diammine dichloride and trans-dibromodiamminpalladium (II).

6. The electroplating process for a bonding copper wire plated with palladium and gold according to claim 4, wherein in electroplating the second palladium layer, in the second palladium plating solution, a concentration of the palladium salt is maintained at 6-10 g/L, a concentration of the 3-chloro-4-fluoroaniline is maintained at 3-13 mg/L, a concentration of the calcium dinonylnaphthalene sulfonate is maintained at 2-6 mg/L, and a concentration of the β-cyano-L-alanine is maintained at 12-22 mg/L.

7. The electroplating process for a bonding copper wire plated with palladium and gold according to claim 1, wherein the copper wire has a diameter of 180-220 μm; the electroplating process for a bonding copper wire plated with palladium and gold further comprises performing a first wire drawing to the semi-finished product, and the semi-finished product has a diameter of 90-105 μm after the first wire drawing; and the electroplating process for a bonding copper wire plated with palladium and gold further comprises performing a second wire drawing to the finished product, and the finished product has a diameter of 15-22 μm after the second wire drawing.

8. The electroplating process for a bonding copper wire plated with palladium and gold according to claim 1, wherein the electroplating the first palladium layer, the electroplating the first gold layer, the electroplating the second palladium layer and the electroplating the second gold layer are performed at a temperature of 70-85° C., with a current of 10-80 mA, for a period of 10-30 min.

* * * * *